United States Patent [19]

Manheimer et al.

[11] Patent Number: 4,491,765

[45] Date of Patent: Jan. 1, 1985

[54] QUASIOPTICAL GYROKLYSTRON

[75] Inventors: Wallace M. Manheimer; Edward Ott, both of Silver Spring, Md.; Anders Bondeson, Gothenburg, Sweden

[73] Assignee: The United States of America as represented by the Secretary of the Navy, Washington, D.C.

[21] Appl. No.: 414,129

[22] Filed: Sep. 2, 1982

[51] Int. Cl.[3] ..... H01J 25/00

[52] U.S. Cl. ..... 315/4; 372/2; 315/3; 315/5; 315/5.44

[58] Field of Search ..... 315/3, 4, 5, 5.41, 5.44; 372/2, 97, 99; 330/4, 4.1

[56] References Cited

U.S. PATENT DOCUMENTS

| | | | |
|---|---|---|---|
| 3,072,817 | 1/1963 | Gordon | 315/3 |
| 3,398,376 | 8/1968 | Hirshfield | 315/5 X |
| 3,463,959 | 8/1969 | Jory et al. | 315/5.41 |
| 4,189,660 | 2/1980 | Dandl | 315/4 |
| 4,197,483 | 4/1980 | Karayianis et al. | 315/4 |
| 4,253,068 | 2/1981 | Barnett | 315/3 |
| 4,287,488 | 9/1981 | Brau et al. | 372/2 |
| 4,370,621 | 1/1983 | Sprangle et al. | 315/5 |
| 4,389,593 | 6/1983 | De Santis et al. | 315/4 |
| 4,438,513 | 3/1984 | Elias et al. | 372/2 |

FOREIGN PATENT DOCUMENTS

| | | | |
|---|---|---|---|
| SU0938333 | 6/1982 | U.S.S.R. | 315/4 |

OTHER PUBLICATIONS

Sprangle et al., "A Classical Electron Cyclotron Quasi Optical Maser", Appl. Phys. Lett. 38 (5), pp. 310–313, (Mar. 1981).

"Theory of the Quasi Optical Electron Cyclotron Maser", Phys. Rev. 23 (6), pp. 3127–3137, (Jan. 1981), Sprangle et al.

*Primary Examiner*—Saxfield Chatmon

*Attorney, Agent, or Firm*—Robert F. Beers; William T. Ellis; Alan P. Klein

[57] ABSTRACT

A quasioptical gyroklystron for generating high power quasioptical radiation. A mildly relativistic electron beam gyrating in a static magnetic field is passed through a first open mirror resonator where a small change in the transverse electron energy takes place (either an increase or decrease depending on the relative phase between the electron gyration and the resonator wave fields). This small change than leads to slower (or more rapid) gyration of those electrons that have gained (or lost) energy in the first resonator. The length of the drift region between the first and a second open mirror resonator is adjusted so that rapidly gyrating electrons overtake slowly gyrating ones at the entrance to the second resonator. Thus the particles arrive at the second resonator strongly bunched in gyration phase. The fields in the first resonator are generated by feedback of a small amount of energy from the wave mode in the second resonator with a $\pi/2$ phase lag so that the beam entering the second resonator is bunched at the right phase angle to lose power efficiently to the fields in the second resonator. The lost power is extracted and guided to a utilization device.

6 Claims, 1 Drawing Figure

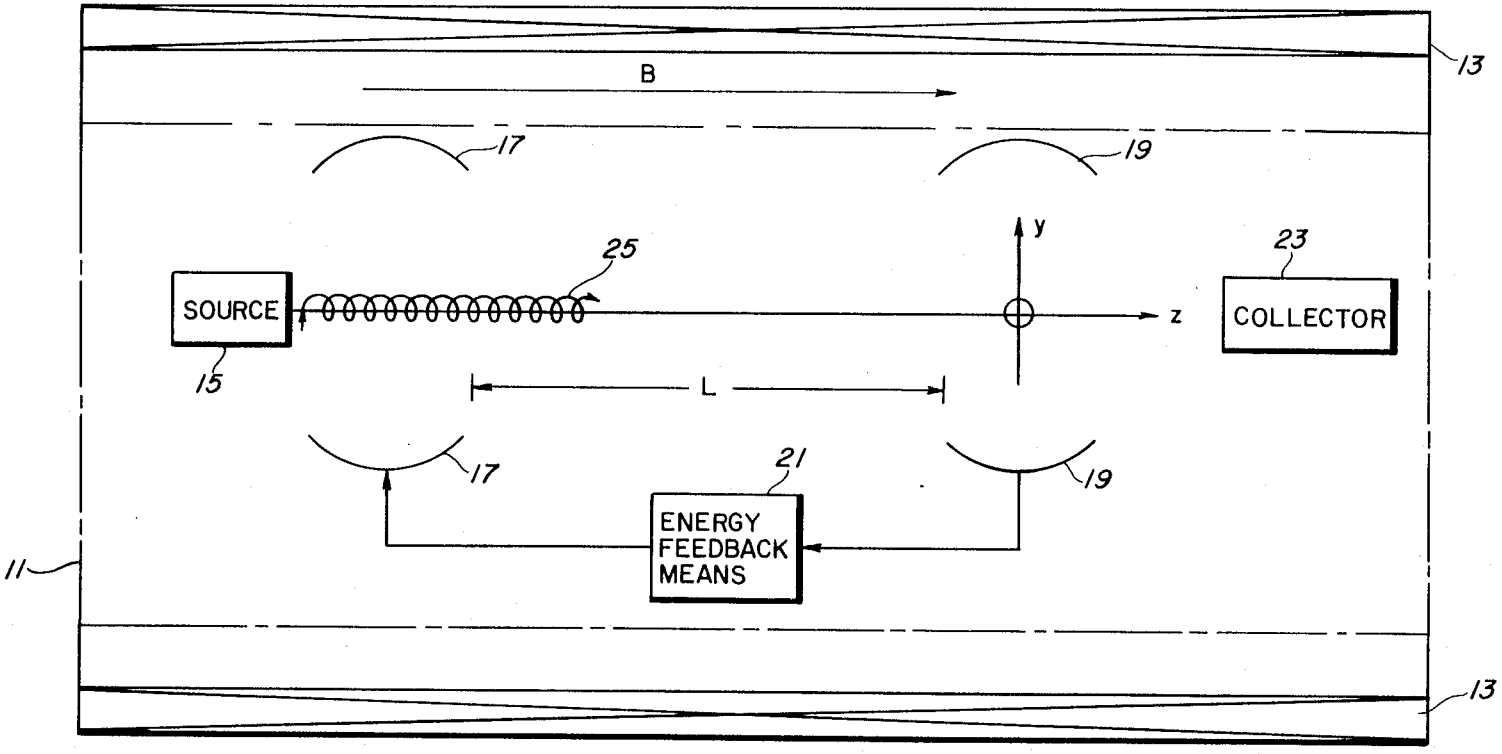
13
13
COLLECTOR
23
z
19
19
y
B
L
21
ENERGY FEEDBACK MEANS
25
17
17
SOURCE
15
11

QUASIOPTICAL GYROKLYSTRON

BACKGROUND OF THE INVENTION

The present invention relates to an apparatus for generating microwave and millimeter wave (quasioptical) radiation by stimulating the coherent emission of cyclotron radiation from a beam of free electrons.

The major device currently covering the millimeter wavelength regime is the gyrotron. This radiation source has demonstrated very high operating power capabilities and efficient operation. Though the operating power level of the gyrotron is high, it is limited by the relatively small interaction volume. More conventional sources, such as mm lasers, klystrons and travelling wave tubes, operate at substantially lower power levels and are somewhat inefficient.

SUMMARY OF THE INVENTION

It is therefore an object of the present invention to efficiently generate high power electromagnetic radiation in the millimeter and submillimeter regime.

This and other objects of the present invention are achieved by a quasioptical gyroklystron. The quasioptical gyroklystron includes means for producing a magnetic field parallel to an axial direction, and a relativistic electron beam source for imparting momentum to electrons in the axial direction to define an electron beam traveling in the axial direction, and for imparting momentum to the electrons in the beam perpendicular to the axial direction to cause the electrons in the beam to execute a gyratory motion. A first open confocal spherical mirror resonator is positioned downstream of the electron beam source for receiving therethrough the beam of electrons and for exchanging energy with the beam to vary the speed of gyration of each electron in the beam according to the relative phase between its gyration and wave mode fields in the first resonator. A second open confocal spherical mirror resonator is positioned downstream of the first resonator for next receiving therethrough the beam of electrons and is separated from the first resonator by a sufficient distance that rapidly gyrating electrons in the beam overtake slowly gyrating electrons at the entrance to the second resonator with the right phase angle to lose power efficiently to wave mode fields in the second resonator. The first and second resonators have a wave mode frequency slightly more than an integral multiple of the relativistic cyclotron frequency of the gyrating electrons in the beam. Energy feedback means is coupled to the first and second resonators for feeding back a small amount of energy to the first resonator from the mode in the second resonator with a phase lag of approximately $\pi/2$ to generate the wave mode fields in the first resonator. A collector electrode is positioned downstream of the second resonator for collecting the electrons in the beam.

The separation L between the first and second resonators along the axial direction is given by the expression $$L = \frac{4p_z^2c^2}{\sqrt{\pi}\ \omega p_\perp e E_{01} r_{01}} \exp\left[\frac{(\Omega - \gamma_0\omega)^2 r_{01}^2 m^2}{4p_z^2}\right]$$

where:

$p_z$=momentum in the axial direction of each of the electrons in the beam at the entrance to the first resonator.

c=speed of light.

$\omega$=common single wave mode frequency of the first and second resonators.

$p_\perp$=momentum perpendicular to the axial direction of each of the electrons in the beam at the entrance to the first resonator.

e=charge of the electron.

$E_{01}$ =wave-mode electric field amplitude in the first resonator.

$r_{01}$=radial extent of the wave-mode electric field amplitude in the first resonator.

B=static magnetic field amplitude.

$\Omega$=eB/mc=non-relativistic cyclotron frequency.

$\gamma_o=[1+(p_z+p_\perp)^2/m^2c^2]^{\frac{1}{2}}$=relativistic factor of the electrons at the entrance to the first resonator.

m=mass of the electron.

The quasioptical gyroklystron has the following advantages:

(a) Highly efficient operation: The radiated power is calculated to be 50% of the electron beam power emitted from the electron beam source.

(b) High radiation output power, of the order of many megawatts can in principle be obtained.

(c) Combination of short wavelength operation with a large radiation volume.

(d) Low electron beam voltage requirements: Efficient operation is possible with electron beam energies ranging from as low as a few keV's to several hundred keV's.

(e) Natural selection of operating transverse mode (fundamental or higher harmonic) due to diffraction losses.

(f) Relative insensitivity to electron beam quality: A moderate thermal spread of the electron beam does not destroy the interaction.

(g) The klystron configuration gives higher efficiency, more of a tendency for single mode operation, and higher efficiency at lower current than a single cavity quasioptical electron cyclotron maser.

(h) Active and/or passive longitudinal mode selection can be employed in the first resonator containing the lower power radiation.

(i) A small magnetic field ripple in the region between the two resonators can be used to control the frequency bandwidth of the device.

The foregoing, as well as other objects, features and advantages of the present invention will become more apparent from the following detailed description when taken in conjunction with the appended drawings.

BRIEF DESCRIPTION OF THE DRAWINGS

The sole FIGURE is an illustrative diagrammatic view of an embodiment of the quasioptical gyroklystron.

DESCRIPTION OF THE PREFERRED EMBODIMENT

Referring to the FIGURE, the quasioptical gyroklystron employs an evacuated tube 11 surrounded by means such as solenoidal windings 13 for producing an axial magnetic field B whose direction is indicated by arrow z; a relativistic electron beam source 15 axially disposed within the tube; a first open confocal spherical mirror resonator 17 positioned downstream of the electron beam source; a second open confocal spherical mirror resonator 19 positioned downstream of the first resonator; energy feedback means 21 coupled between the second and first resonators; and a collector electrode 23 positioned downstream of the second resonator.

While the relativistic electron beam source may take a variety of forms, conveniently it may take the form of a magnetron injection gun as described in the article "An Investigation of a Magnetron Injection Gun Suitable for Use in Cyclotron Resonance Masers" by J. L. Seftor et al. in *IEEE Transactions on Electron Devices,* Vol. ED-26, No. 10, October 1979, pp. 1609–1616, whose disclosure is herewith incorporated by reference. Suitable mirror resonators are described in Section 4.3 of the text *Introduction to Optical Electronics,* 2nd Ed., by Amnon Yariv and references cited therein, and the disclosures thereof are also incorporated by reference. Finally, while the energy feedback means 21 may take a variety of forms, conveniently it may take the form of a waveguide with a squeeze-section phase-shifter, such as described in Section 9.2.1 of the text *Plasma Diagnostics with Microwaves* by M. A. Heald and C. B. Wharton, whose disclosure is herewith incorporated by reference.

In operation of the quasioptical gyroklystron, the relativistic electron beam source 15 imparts a momentum $p_z$ to each of the electrons in the axial direction indicated by arrow z to define a low energy (mildly relativistic) electron beam 25 traveling in that direction, and imparts a momentum $p_{195}$ to the electrons in the beam perpendicular to the axial direction (e.g., in the direction indicated by the arrow y) to cause the electrons to execute a gyrating motion about the direction of the magnetic field B. The first and second open confocal spherical mirror resonators 17 and 19 have a common single wave mode frequency $\omega$ which is slightly more than an integral multiple of the relativistic cyclotron frequency $\Omega/\gamma_o$ of the electrons in the beam (i.e. their rotation frequency), where $\Omega$ is the non-relativistic cyclotron frequency and $\gamma_o$ is the relativistic factor of the electrons at the entrance to the first resonator 17. The first open confocal spherical mirror resonator 17 receives the electron beam 25 therethrough and exchanges energy with the beam to vary the speed of gyration of each electron in the beam according to the relative phase between its gyratron and the wave mode fields in the resonator 17. The electron beam 25 passes on to the second open confocal spherical mirror resonator 19 which likewise receives the beam of electrons therethrough. The separation of the second resonator 19 from the first resonator 17 is such that rapidly gyrating electrons in the beam 25 overtake slowly gyrating electrons at the entrance to the second resonator 19 with the right phase angle to lose power efficiently to wave mode fields in the second resonator. The beam 25 of electrons exits the second resonator 19 and is collected by the collector electrode 23. The feedback means 21 feeds back a small amount of energy to the first resonator 17 from the mode in the second resonator 19 with a phase lag of approximately $\pi/2$ to generate the wave mode fields in the first resonator. The power lost by the electrons to the wave mode fields in the second resonator 19 can be extracted by recovering the energy lost through diffraction or by making one or both of the mirrors of the second resonator partially transmitting at the wave mode frequency so that the energy passes through the mirrors. The extracted power can then be guided to a utilization device (not shown).

The separation between the two resonators 17 and 19 along the axial direction for uniform B is given by:

$$L = \frac{4p_z^2c^2}{\sqrt{\pi}\ \omega p_\perp e E_{01} r_{01}} \exp\left[\frac{(\Omega - \gamma_0\omega)^2 r_{01}^2 m^2}{4p_z^2}\right]$$

wherein:

c=speed of light.

e=charge of the electron.

$E_{01}$=wave-mode electric field amplitude in the first resonator 17.

$r_{01}$=radial extent of the wave-mode electric field in the first resonator 17.

m=mass of the electron.

It is obvious that many modifications and variations of the present invention are possible in light of the above teachings. It is therefore to be understood that within the scope of the appended claims, the invention may be practiced otherwise than as described.

What is claimed as new and desired to be secured by Letters Patent of the United States is:

1. A quasioptical gyroklystron comprising:

means for producing a magnetic field parallel to an axial direction;

a relativistic electron beam source for imparting momentum to electrons in the axial direction to define an electron beam traveling in the axial direction, and for imparting momentum to the electrons in the beam perpendicular to the axial direction to cause the electrons in the beam to execute a gyratory motion;

a first open confocal spherical mirror resonator positioned downstream of the electron beam source for receiving therethrough the beam of electrons and for exchanging energy with the beam to vary the speed of gyration of each electron in the beam according to the relative phase between its gyration and wave mode fields in the first resonator;

a second open confocal spherical mirror resonator positioned downstream of the first resonator for receiving therethrough the beam of electrons, the second resonator being separated from the first resonator by a sufficient distance that rapidly gyrating electrons in the beam overtake slowly gyrating electrons at the entrance to the second resonator with the right phase angle to lose power efficiently to wave mode fields in the second resonator, energy feedback means coupled to the first and second resonators for feeding back a small amount of energy to the first resonator from the mode in the second resonator with a phase lag of approximately $\pi/2$ to generate the wave mode fields in the first resonator;

the first and second resonators having a wave mode frequency slightly more than an integral multiple of the relativistic cyclotron frquency of the gyrating electrons in the beam; and a collector electrode positioned downstream of the second resonator for collecting the electrons in the beam.

2. The quasioptical gyroklystron recited in claim 1 wherein the separation L between the first and second resonators along the axial direction is given by the expression $$L = \frac{4p_z^2c^2}{\sqrt{\pi}\ \omega p_\perp e E_{01} r_{01}} \exp\left[\frac{(\Omega - \gamma_0\omega)^2 r_{01}^2 m^2}{4p_z^2}\right]$$

wherein:

$p_z$=momentum in the axial direction of each of the electrons in the beam at the entrance to the first resonator;

c=speed of light;

$\omega$=common single wave mode frequency of the first and second resonators; $p_\perp$=momentum perpendicular to axial direction of each of the electrons in the beam at the entrance to the first resonator;

e=charge of the electron;

$E_{01}$=wave-mode electric field amplitude in the first resonator;

$r_{01}$=radial extent of the wave-mode electric field amplitude in the first resonator;

B=static magnetic field amplitude;

$\Omega$=eB/mc=non-relativistic cyclotron frequency;

$j_o=[1+(p_z+p_\perp)^2/m^2c^2]^{\frac{1}{2}}$=relativistic factor of the electrons at the entrance to the first resonator;

m=mass of the electron.

3. The quasioptical gyroklystron recited in claim 1 wherein the the magnetic field producing means includes:

solenoidal windings.

4. The quasioptical gyroklystron recited in claim 1 wherein the relativistic electron beam source includes:

a magnetron injection gun.

5. The quasioptical gyroklystron recited in claim 1 wherein the feedback means includes:

a waveguide with a squeeze section phase-shifter.

6. The quasioptical gyroklystron recited in claim 1 wherein:

the second resonator is formed by two opposing spherical mirrors, at least one of the mirrors being partially transmitting at the wave mode frequency.

* * * * *